US006769955B1

(12) United States Patent
Fisher

(10) Patent No.: US 6,769,955 B1
(45) Date of Patent: Aug. 3, 2004

(54) ANTI-WRINKLE BRA FOR SLEEPING

(76) Inventor: Kelly J. Fisher, 2320 N. Saint Vrain St., El Paso, TX (US) 79902

( * ) Notice: Subject to any disclaimer, the term of this patent is extended or adjusted under 35 U.S.C. 154(b) by 0 days.

(21) Appl. No.: 10/643,460

(22) Filed: Aug. 18, 2003

(51) Int. Cl.[7] ..... A41C 3/00
(52) U.S. Cl. ..... 450/54; 450/57; 2/267
(58) Field of Search ..... 450/54–57, 31, 450/32, 39, 89; 2/267, 268, 73, 78.1–78.4, 104–106, 69, 114, 463; 602/60, 61; 128/845, 846, 848, 873–876, 889–891

(56) References Cited

U.S. PATENT DOCUMENTS 862,376 A * 8/1907 Bachman ..... 450/57
5,083,555 A * 1/1992 Lewis ..... 602/6
5,158,541 A * 10/1992 McCurley ..... 602/79
5,807,160 A * 9/1998 Wehmeyer ..... 450/57
5,843,008 A * 12/1998 Gerhard ..... 602/5
5,951,366 A * 9/1999 Stevens ..... 450/57
6,095,894 A * 8/2000 Stevens ..... 450/57
6,102,772 A * 8/2000 Fernandez ..... 450/1
6,439,958 B1 * 8/2002 Lorenzo ..... 450/1
6,517,410 B1 * 2/2003 Underhill ..... 450/1

* cited by examiner

*Primary Examiner*—Gloria M. Hale
(74) *Attorney, Agent, or Firm*—Donald W. Meeker

(57) ABSTRACT

A soft fabric bra with a center breast support pad to be worn by a woman while sleeping that is structured to support an upper breast, with the woman sleeping on her side, to prevent the upper breast from sagging and thereby prevent the formation of wrinkles in the skin of the upper chest of the woman.

6 Claims, 3 Drawing Sheets

ANTI-WRINKLE BRA FOR SLEEPING

BACKGROUND OF THE INVENTION

1. Field of the Invention

The present invention relates to sleeping brassieres and in particular to a bra worn while sleeping that is structured to reduce the formation of wrinkles in the upper chest of women who sleep on their sides, which bra has a center insert of a firm resilient material fit within a soft fabric bra.

2. Description of the Prior Art

When women sleep on their sides, the breast on the upper side tends to hang down toward the lower breast causing wrinkles to form in the skin in the center of the chest, just above and between their breasts. Brassieres for supporting the breasts are well known, such brassieres are generally designed primarily to support the breasts when the wearer is standing. However, such prior art devices have not been entirely successful in separating the breasts to prevent the wrinkle that forms in between the breasts when the wearer is lying on her side during sleep.

Prior art U.S. Pat. No. 5,897,422, issued Apr. 27, 1999 to McGee, provides a sleeping brassiere that has a pair of shoulder supports, which extend to a back support. The sleeping brassiere also has a back support that extends from the back toward the front of the wearer, a portion encircling the wearer and a pair of cup-shaped breast supports. Each of the breast supports has a generally crescent-shaped portion curving generally around the outside and top of the wearer's breast. The crescent-shaped portion has an upper end adjoining the shoulder supports and a lower end adjoining the portion of said back support encircling the wearer at a position generally between and below the breasts of the wearer when the brassiere is worn.

Prior art U.S. Pat. No. 5,083,555, issued Jan. 28, 1992 to Lewis, shows an apparatus suitable for reducing and preventing skin deformation in proximity to the breasts of a human female when worn between said breasts, which includes a shaped deformable resilient central support member that has a first end and a second end. A removable outer casing encompasses the shaped central support member, the casing has a first casing end adjacent the first support member end and a second casing end adjacent the second support member end. A first closure means is positioned at the first casing end and a second closure means is positioned at the second casing end, the closure means being adapted for enclosing the first and second support member ends within the outer casing. A securing means is on the outer casing between the first and second casing ends, the securing means being adapted for securing the apparatus to the torso of a human female and between the breasts of the female to reduce and eliminate skin wrinkling.

Prior art U.S. Pat. No. 5,961,986, issued Oct. 5, 1999 to Killen, claims a preferred embodiment of an anti-wrinkling apparatus that employs a substrate with an adhesive for securing the apparatus to the user's skin for deterring skin folding and, thus, wrinkles. In another aspect of the present invention, the substrate has a substantially heart shape. In a further aspect of the present invention, the apparatus does not have a preformed shape and is flat prior to use. In yet another aspect of the present invention, the anti-wrinkling device of the present invention is applied between the breasts. In still another aspect of the present invention anti-wrinkling apparatus, multiple stacked adhesive and liner layers, as well as a substrate layer, are provided for allowing repeated application and removal.

Prior art U.S. Pat. No. 6,102,772, issued Apr. 15, 2000 to Fernandez, describes an anti-wrinkle brassiere that is specially designed for night use and as an element for preventing inter-mammary wrinkles. It also has a protection element for the back and the dorsal vertebra and it prevents back pain. It has a front portion that covers the intermammary zone and two oblique straps, which are joined to the extended back portion, that prevent the inner sides of the breasts from touching. The straps only cover the shoulder part and form lateral arches, which deviate from the line marked by the day brassiere, for a good lymphatic drainage. It remains fastened to the skin and its inferior border is located a few centimeters under those found on conventional brassieres.

Prior art U.S. Pat. No. 5,807,160, issued Sep. 15, 1998 to Wehmeyer, discloses a cleavage-wrinkle protector that is constructed of satin or similar lingerie-type fabric and stuffed with polyester fiberfill. The protector includes stretch lace neck and torso straps. The protector is approximately 6-½ inches long and 2-½ inches side. The protector is designed to be worn between the woman's breast while sleeping to protect the cleavage skin from folding when she lies on her side.

Prior art U.S. Pat. No. 3,746,007, issued Jul. 17, 1973 to Hand, indicates a ladies sleeping garment that has the elements of a supportive brassiere therein. The garment will support and mold the breast even when the wearer is in an unusual sleeping position.

Prior art U.S. Pat. No. 1,891,871, issued Dec. 20, 1932 to Donnet, puts forth a brassiere with a resilient, stiff and bent strip with rounded edges that is centrally located, which is adapted as a separating member between the breasts.

What is needed is a bra for sleeping which supports the breasts with the woman sleeping on her side to prevent the upper breast from tending to hang down toward the lower breast and thereby prevent wrinkles in the skin in the center of the upper chest.

SUMMARY OF THE INVENTION

An object of the present invention is to provide a bra for sleeping with a center breast support, positioned between the breasts, which supports the breasts with the woman sleeping on her side to prevent the upper breast from tending to hang down toward the lower breast and thereby prevent wrinkles in the skin in the center of the upper chest.

Another object of the present invention is to provide a bra for sleeping that is comfortable and is not exceedingly tight.

One more object of the present invention is to provide a bra for sleeping that is economical and easy to manufacture.

In brief, a sleeping bra that supports an upper breast of a woman sleeping on her side and thereby prevents wrinkles forming in the skin of the upper chest. The sleeping bra has a breast support pad positioned between the breasts of the woman. The support pad comprises a firm body that has a vertical section with a thick midsection and a back surface that conforms to the chest structure of the woman between the breasts. The support pad also has a concave curved cavity or cup on each side of the vertical section that supports either breast of the woman with the breast in an upper position when the woman is sleeping on her side and prevents the breast in the upper position from hanging down toward the lower breast, thereby preventing wrinkling of the skin on the chest of the woman between the breasts. The support pad is formed of a molded firm material, such as a molded dense foam material, to conform to the shape of the chest and breasts between the breasts.

The bra for sleeping also comprises a soft fabric bra with a body encircling portion with a pair of cups for supporting the breasts of a woman and a centrally located pocket for holding the support pad. The pocket is formed by stitching a sheet of material to the inside of the bra between the cups, thereby forming a barrier between the support pad and the skin of the woman.

An advantage of the present invention is that it prevents wrinkles that form in the skin of the cleavage area of the chest.

Another advantage of the present invention is that it is comfortable.

An additional advantage of the present invention is that it is affordable.

BRIEF DESCRIPTION OF THE DRAWINGS

These and other details of my invention will be described in connection with the accompanying drawings, which are finished only by way of illustration and not in limitation of the invention, and in which drawings.

BEST MODE FOR CARRYING OUT THE INVENTION

Figure 1:
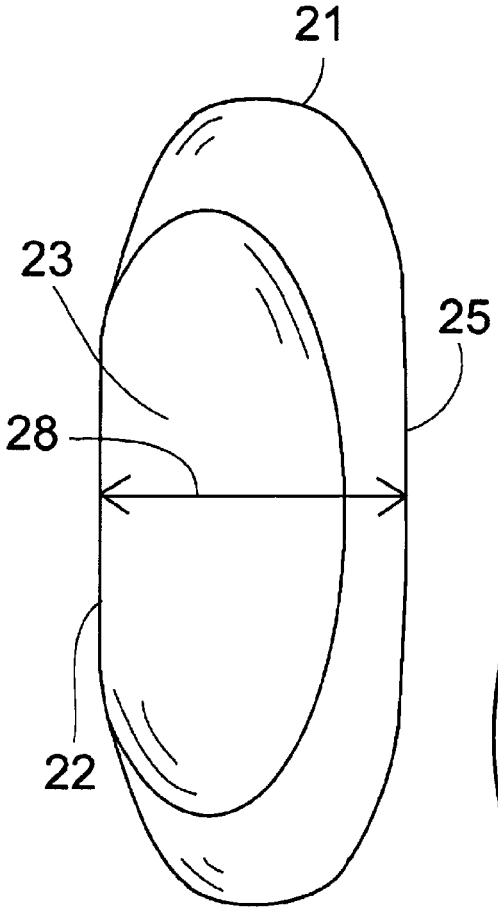
FIG. 1 is a side elevational view of the center insert of the bra of the present invention.
Figure 2:
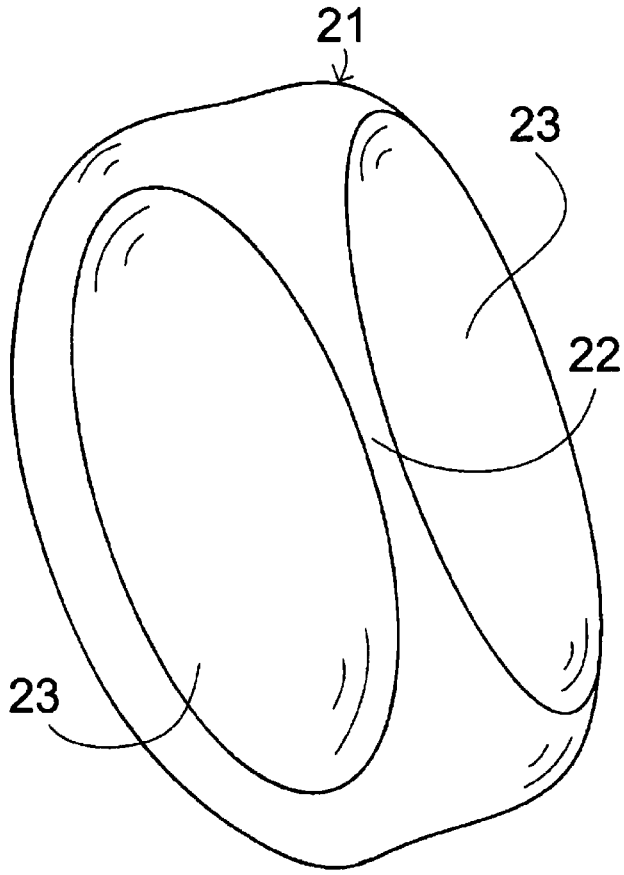
FIG. 2 is a front perspective view of the center insert of FIG. 1.
Figure 3:
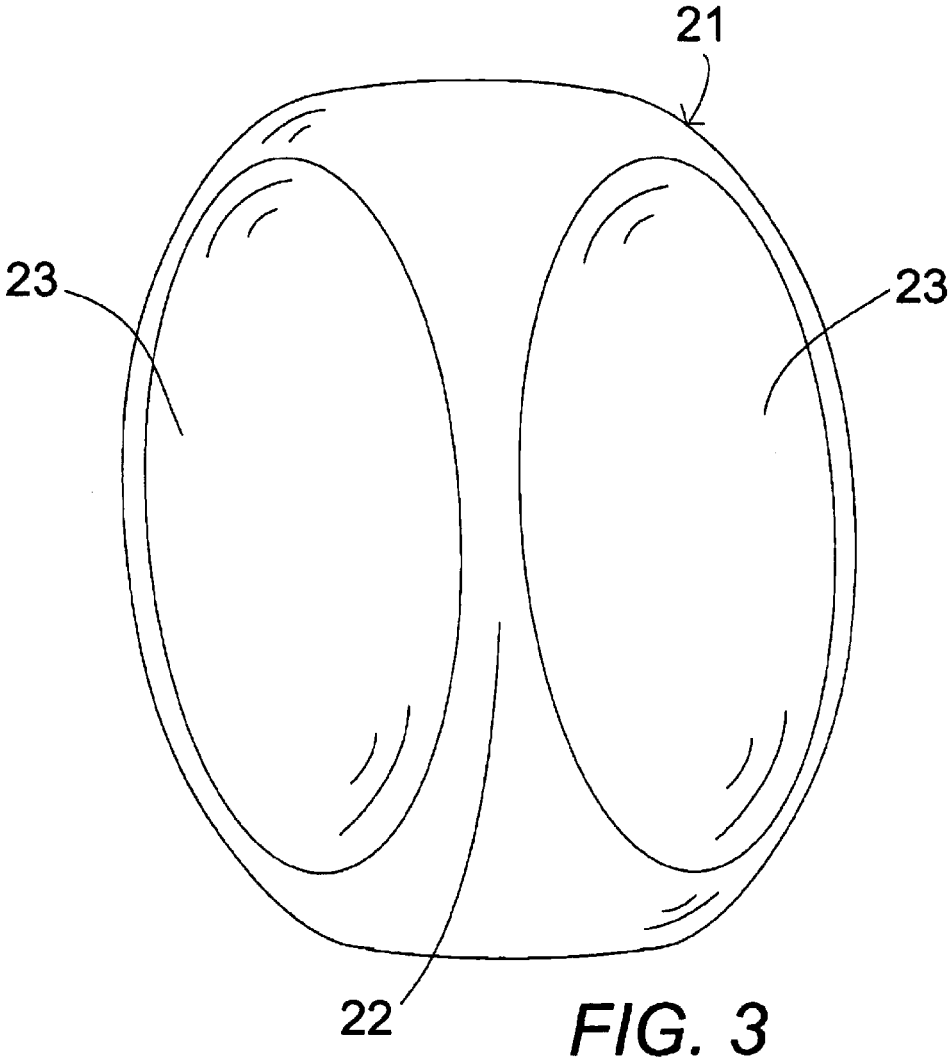
FIG. 3 is a front elevational view of the back of the center insert of FIG. 1.
Figure 4:
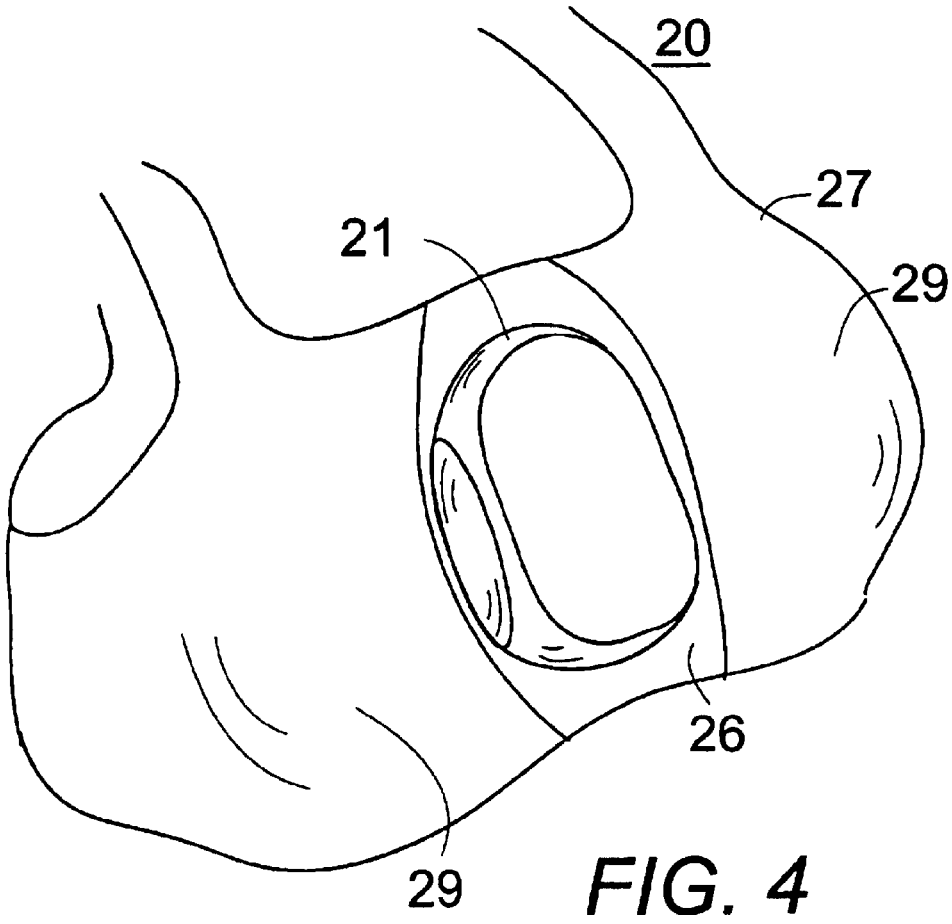
FIG. 4 is a perspective view partially broken away showing the bra of the present invention with the center insert in place and showing a piece of soft fabric sewn onto the inside of the bra to retain the insert in place.

In FIG. 4, a bra 20 for sleeping supports an upper breast of a woman sleeping on her side and thereby prevents wrinkles forming in the skin of the upper chest. The bra 20 comprises a breast support pad 21, as shown in FIGS. 1–4, positioned between the breasts of a woman. The support pad 21 comprises a firm body with a thick midsection 28, as shown in FIG. 1. The support pad 21 further comprises a back surface 22 which conforms to the chest structure of the woman between the breasts. The support pad also has a concave curved cavity 23 or cup, shown in FIGS. 1–3, on each side that supports either breast of the woman with the breast in an upper position when the woman is sleeping on her side and prevents the breast in the upper position from hanging down toward the lower breast, thereby preventing wrinkling of the skin on the chest of the woman between the breasts. The support pad 21 is formed of a molded firm material, such as a molded dense foam material, to conform to the shape of the chest and breasts between the breasts.

In FIG. 4, the bra for sleeping 20 also comprises a soft fabric bra 27 with a body encircling portion with a pair of curved front portions 29 for supporting the breasts of a woman and a centrally located retainer means positioned between the curved front portions 29 for retaining the breast support pad 21 therebetween. The retainer means comprises a pocket, which is formed by stitching a sheet of material 26 to the bra 27 between the curved front portions 29. The sheet of material 26 is formed of soft fabric larger than the support pad 21 and is stitched to a backside of the bra 27, thereby forming a barrier between the support pad 21 and the skin of the woman.

It is understood that the preceding description is given merely by way of illustration and not in limitation of the invention and that various modifications may be made thereto without departing from the spirit of the invention as claimed.

What is claimed is:

1. A breast supporting brassiere to prevent wrinkles on the breasts and the chest skin between the breasts of a wearer while a wearer sleeps on their side and wherein when the wearer is positioned on their side one breast is in an upper position and the other breast lies thereunder in a lower position, the brassiere comprising:

a soft fabric brassiere comprising a body encircling portion with a pair of curved front portions for supporting the breasts of a woman and a centrally located retainer means positioned between the curved front portions adapted to retain the breast support pad therebetween; and a breast support pad adapted for being positioned between the breasts of the wearer, the support pad comprising a firm body having a vertical section with a thick midsection, a back surface adapted for conforming to the chest surface between the breasts of the wearer and a concave curved cavity on each side of the vertical section adapted for supporting either breast of the wearer while on their side to prevent the breast in the upper position from hanging down toward the breast in the lower position and thereby preventing wrinkling of the skin on the chest of the wearer between the breasts.

2. The bra of claim 1 wherein the retainer means comprises a pocket.

3. The bra of claim 2 wherein the pocket is formed by stitching a sheet of material to the bra between the curved front portions.

4. The bra of claim 3 wherein the sheet of material is formed of soft fabric larger than the support pad and the sheet of material is stitched to an inside surface of the front of the brassiere between the support pad and the skin of the woman.

5. The bra of claim 1 wherein the support pad is formed of a firm material molded to conform to the shape of the breast area between the breasts.

6. The bra of claim 5 wherein the support pad is formed of molded dense foam material.

* * * * *